US007011304B2

(12) United States Patent
Flickner et al.

(10) Patent No.: US 7,011,304 B2
(45) Date of Patent: Mar. 14, 2006

(54) COLLATOR APPARATUS

(75) Inventors: Brett Flickner, Folsom, CA (US); Christian Tammi, El Dorado Hills, CA (US); Robert Kellett, Redding, CA (US)

(73) Assignee: DST Output, Inc., El Dorado Hills, CA (US)

( * ) Notice: Subject to any disclaimer, the term of this patent is extended or adjusted under 35 U.S.C. 154(b) by 113 days.

(21) Appl. No.: 10/411,588

(22) Filed: Apr. 10, 2003

(65) Prior Publication Data

US 2004/0201164 A1 Oct. 14, 2004

(51) Int. Cl.
*B65H 29/00* (2006.01)

(52) U.S. Cl. ..... 271/189; 271/3.14; 271/265.01; 271/3.03

(58) Field of Classification Search ..... 271/189, 271/207, 3.03, 3.14, 265.01
See application file for complete search history.

(56) References Cited

U.S. PATENT DOCUMENTS

| | | | | |
|---|---|---|---|---|
| 4,453,870 | A | 6/1984 | Bean | |
| 4,640,506 | A * | 2/1987 | Luperti et al. | 271/212 |
| 4,733,856 | A | 3/1988 | Gunther, Jr. | |
| 4,750,853 | A | 6/1988 | Van Soest et al. | |
| 4,799,663 | A * | 1/1989 | Golicz | 271/199 |
| 4,800,505 | A | 1/1989 | Axelrod et al. | |
| 4,826,383 | A | 5/1989 | Millen | |
| 4,934,687 | A | 6/1990 | Hayden et al. | |
| 5,285,249 | A | 2/1994 | Mahoney | |
| 5,342,038 | A * | 8/1994 | Suter | 271/198 |
| 5,462,399 | A | 10/1995 | Clupper et al. | |
| 5,590,873 | A * | 1/1997 | Smart et al. | 271/303 |
| 5,816,773 | A * | 10/1998 | Fehringer et al. | 414/789.9 |
| 6,551,052 | B1 * | 4/2003 | Bakoledis | 404/790.3 |
| 6,776,409 | B1 * | 8/2004 | Cook | 271/189 |
| 6,796,558 | B1 * | 9/2004 | Dorer | 271/189 |

FOREIGN PATENT DOCUMENTS

| | | |
|---|---|---|
| GB | 1538066 | 1/1979 |

* cited by examiner

*Primary Examiner*—Patrick Mackey
(74) *Attorney, Agent, or Firm*—James M. Ritchey

(57) ABSTRACT

A collator for assembling a packet from one or more sheets, includes a sheet collating tray, a retractable sheet stop within said sheet collating tray for stopping and aligning a leading edge of each sheet entering the sheet collating tray, thereby producing an aligned sheet packet, a movable sheet kicker for initiating output of the aligned sheet packet from the sheet collating tray, and sheet packet-grasping packet transfer belts for delivering from the collating tray each of the aligned sheet packets to downstream processing equipment. To optimize operational timing of the collator and for monitoring sheet progress through the collator, a programmed computer is provided that oversees for efficiency and possible errors sheet entry into the sheet collating tray, the presence of one or more sheets within the sheet collating tray, and the aligned sheet packet departure from the sheet collating tray.

24 Claims, 10 Drawing Sheets

COLLATOR APPARATUS

BACKGROUND OF THE INVENTION

1. Field of the Invention

A collator apparatus is disclosed in which computer controlled sensors monitor that one sheet or multiple sheets are received from upstream process equipment and aligned (aligned and combined for multiple sheets) into a packet that has each sheet's leading edge aligned and then delivers the aligned packet to downstream processing equipment. More specifically, the subject apparatus is a collator that prepares a leading-edge-aligned packet from one or more variable length sheets delivered from upstream components and outputs the leading-edge-aligned packet to a folding apparatus for eventual insertion into a mailing envelope and includes computer-facilitated error-sensor means that monitors the collator's contents and determines optimal timing in the actuation of the collator's output delivery mechanisms.

2. Description of the Background Art

Large volume mailings, such as periodic billing operations and mass advertising, require high speed processing of large numbers of mail packets or statements for delivery to customers or prospective customers, often these packets or statement contain one or more inserts and a return envelope. Periodic billing statements, such as those prepared in typical monthly billing operations, each billing statement generally includes a plurality of pages, forms, or sheets of printed material which are ultimately sent to a customer in a single envelope. The billing statement must be correctly organized, collated, folded, and inserted into envelopes for mailing to customers. A variety of high-volume or bulk mail processing systems and methods are known for performing such mail preparation operations, and generally operate at high speeds under computer control.

For assembling multiple sheets of documents, various types of collators exist, as are illustrated in the following patents.

Disclosed in U.S. Pat. No. 5,462,399, issued to the assignee of the subject invention, is a vertical tray collator with a sheet discharge pusher member. A multi-tray collator creates document packets, each packet with one or more sheets, as directed by a computer. A plurality of inputting mechanisms, from one or more directions, feeds sheets into the trays where collation occurs. The collated document packets are then transferred by outputting means to subsequent processor equipment.

Described in U.S. Pat. No. 5,816,773, issued to the assignee of the subject invention, is a collator apparatus for collation of a plurality of sheets having varying lengths of widths. Each sheet drops, by gravity from a sheet source, into a tray of the collator and the leading edge of each sheet aligns against a stopper. Once all of the sheets in a desired document packet are registered in the tray, a controlling computer directs a plurality of pincher rollers to engage the leading edge of the sheet-stacked document packet and to remove the packet from the tray.

Disclosed in British Patent No. 1538-066 is a collating device that assembles pages of a book or booklet. Two height-staggered platforms receive incoming pages and pushers then merge the received pages into a compiled stack.

An accumulator is related in U.S. Pat. No. 4,453,870. Pages are delivered from an upper level conveyor to a lower level working area. At the start of the lower level working area single sheets accumulate in a set against a gate. When the gate opens pinch rollers propel the set of sheets to the working area.

A mechanism for assembling a personalized letter assembly is presented in U.S. Pat. No. 4,733,856. An envelope and insert pages are matched and assembled into a final mailing packet.

U.S. Pat. No. 4,750,853 describes a device for conveying a bundle of sheets from a first location to a second location. An abutment strip stops incoming pages until the bundle is created. When activated, a cam mechanism coupled to the abutment strip then raises the abutment strip and paired pinch-rollers move the bundle to the second location.

U.S. Pat. No. 4,800,505 provides a mail preparation system that includes an inserter than functions as a type of envelope/insert pages collator in which a mailing packet is generated.

A sheet compiler that has a drive means for removing a compiled set of sheets is related in U.S. Pat. No. 4,826,383. A sheet stacker registers a group of incoming sheets into a complete set and then ejects the complete set by retracting registration members. Sheet traction is by means of traditional pinch rollers that retract as the set is formed and engaged to effect ejection.

U.S. Pat. No. 4,934,687 discloses a high speed stream fed stacker in which sheet are collated as they exit paired belts in an overlapping fashion. A flow interrupting arm merely blocks the flow of overlapping sheets, as directed by the counter, to create a desired stack of pages.

A finishing apparatus for stapling sheets that are stacked in a first-to-last or reverse order is presented in U.S. Pat. No. 5,285,249. A plurality of sheets collect in either an "up" or "down" orientation by means of entering a holding tray by a first or second means, respectively. Movable stop members block a stack from exiting the holding tray until directed to do so and then are transferred by suitable means. The stack can be stapled from either side by means of paired stapling means located proximate opposite edges of the holding tray.

The foregoing information and patents reflect the state of the art of which the applicant is aware and are tendered with the view toward discharging applicant's acknowledged duty of candor in disclosing information which may be pertinent in the examination of this application. It is respectfully submitted, however, that none of these patents teaches or renders obvious, singly or when considered in combination, applicant's claimed invention.

SUMMARY OF THE INVENTION

An object of the present invention is to provide a collator system that includes computer-facilitated sensors that allow optimal timing in the actuation of the collator's output delivery mechanism and to allow monitoring of the collator's contents for statement quality assurance purposes.

Another object of the present invention is to furnish a collator and control system that collates multiple pages into a packet that has each sheet leading edge aligned and then delivers the aligned packet to downstream processing equipment A further object of the present invention is to supply a collator that comprises a sheet transfer means, an adjustable width and length receiving tray that aligns the leading edges of incoming sheets, an output kicker means that initiates the transfer of documents to downstream equipment, and computer-facilitated sensors that monitor and time the process.

Still another object of the present invention is to disclose a collator comprising collation means and computer-facilitated error and timing means comprising three sensors, wherein the computer regularly monitors if each sensor is open or blocked.

Yet a further object of the present invention is to describe a sheet transfer means, an adjustable width and length receiving tray that aligns the leading edges of incoming sheets to produce a packet, an output kicker means that initiates the transfer of the aligned packet to downstream equipment, and computer-facilitated monitoring means for monitoring processes within the receiving tray and comprising three sensors with a first sensor monitoring incoming sheets, a second sensor monitoring an outgoing packet, and a third sensor monitoring sheets within the receiving tray, wherein the computer regularly monitors if each sensor is open or blocked.

Yet still another object of the present invention is to provide a "non-marking" sheet collator that allows collated sheets to rest in a collator tray without contacting a moving belt until the collated sheets exit the tray as an aligned packet.

Disclosed is a collator for assembling a sheet containing packet from one or more desired and designated sheets, often one or more sheets of a billing statement that is to be mailed within a sending envelope. Comprising the subject collator is a sheet collating tray that has an entrance and an exit that adjusts to accommodate variable width and length sheets. Preferably, the collating tray comprises a frame having first and second side members secured to one or more support cross-members that link the first and the second side frame members to one another. Running approximately parallel with the first and second side frame members and forming the bottom supports of the collator tray are one or more support ribs upon which incoming sheets set, wherein each of the support ribs has a first end proximate the collating tray entrance and a second end proximate the collating tray exit. Within the frame members are first and second side rails with the first side rail adjustably mounted proximate the first side frame member and the second side rail adjustably mounted proximate the second side frame member. Variable length sheets are accommodated by having a sheet-hold-down member that spans the first and second side members and is positionally adjustable along the first and second side members. The sheet-hold-down member is positioned is a first orientation for shorter sheets and in a second or flipped orientation for longer sheets.

Incoming sheets transfer into the collator tray by means of their momentum produced by the input means and come to rest against the stop means and on the collator tray support ribs.

Additionally, sheet stop means are included within the sheet collating tray for stopping and aligning a leading edge of each sheet entering the sheet collating tray. This aligning/stopping produces an aligned sheet packet that sits upon the support ribs within the collator tray. The sheet stop means comprises a retractable stop plate that produces the distal end of the collator tray or the exit of the tray and a first actuator, usually a pneumatic air cylinder or a solenoid, affixed to the stop plate. The first actuator retracts (lowers or raises depending on its relative mounted position below or above the sheet stream) and extends (raises or lowers depending on its relative mounted position below or above the sheet stream) the stop plate, wherein when the stop plate is extended the leading edge of each sheet aligns against the stop plate and when the stop plate is retracted the aligned sheet packet may exit the collating tray.

To eject the aligned sheet packet from within the collator tray a sheet kicker means is described, wherein the sheet kicker comprises a kicker plate mounted proximate the collator tray entrance and a second actuator, usually a pneumatic cylinder or a solenoid, attached to the kicker plate. When the stop plate is retracted the second actuator is activated to eject the aligned sheet packet from within the collating tray.

Sheet packet transfer means for delivering from the collating tray each the aligned sheet packet to downstream processing equipment is included in the subject apparatus. The packet transfer means comprises a plurality of sheet packet-grasping belts between which the aligned sheet packet exits to the downstream processing equipment.

Computer-facilitated means for optimizing operational timing of the collator and for monitoring sheet progress through the collator oversees operation of the collator. Monitored are entry into the sheet collating tray, presence of one or more sheets within the sheet collating tray, and the aligned sheet packet departure from the sheet collating tray. The computer-facilitated means for optimizing operational timing of the collator and for monitoring sheet progress through the collator comprises a computer means in communication with the collator, programming in the computer means for optimizing operational timing of the collator and for monitoring sheet progress through the collator, wherein the programming controls the sheet stop means, the sheet kicker means, and the packet transfer means, and sensor means mounted to the collator and coupled to the computer means for detecting sheet progress through the collator.

Specifically, the sensor means comprises a plurality of sheet detecting devices. More specifically, the sensor means comprises three specifically positioned sensors, wherein the associated computer means regularly monitors if each sensor is open or blocked. First, an input sensor is located proximate the sheet kicker means of the collator, wherein the input sensor notifies the computer means of the entry of a sheet into the collator. Second, an output sensor is located proximate the sheet stop means of the collator, wherein the output sensor notifies the computer means that the aligned packet is starting to exit the collator. Third, an internal sensor is located between the sheet kicker means and the sheet stop means of the collator, wherein the internal sensor notifies the computer means that no sheet remains within the collator after the aligned sheet packet exits the collator and before one or more sheets for a new packet arrive.

Other objects, advantages, and novel features of the present invention will become apparent from the detailed description that follows, when considered in conjunction with the associated drawings.

DESCRIPTION OF THE PREFERRED EMBODIMENT

Figure 1:
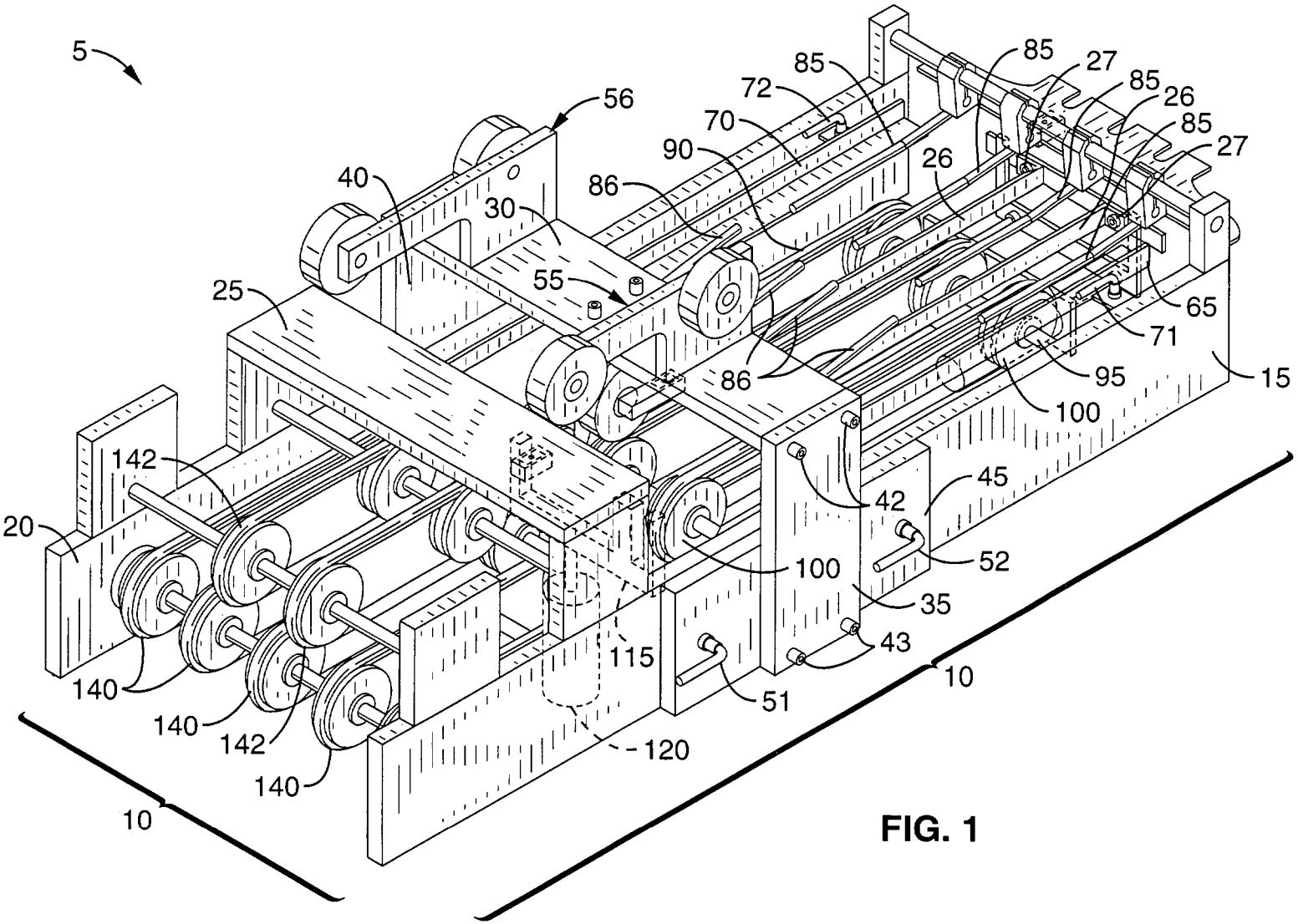
FIG. 1 is a perspective view of the subject collator.
Figure 2:
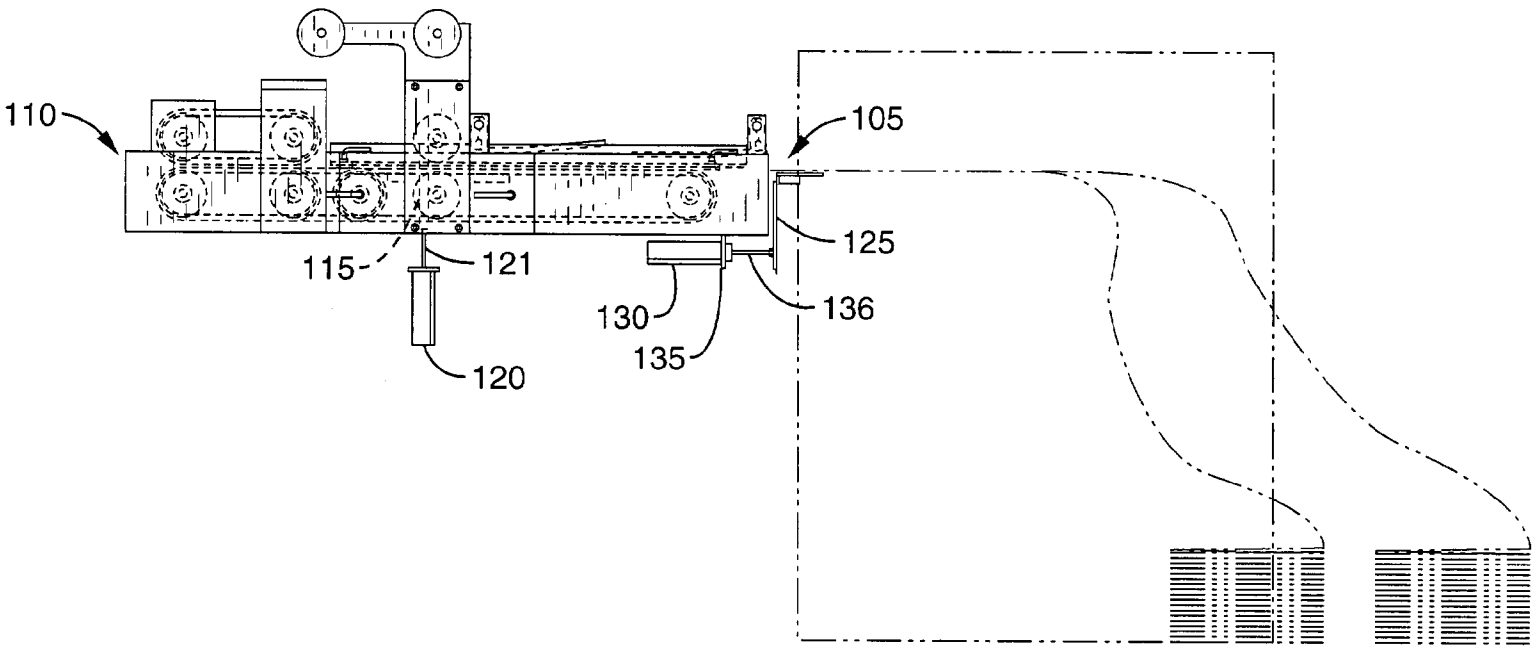
FIG. 2 is a side view of the subject collator showing two incoming streams of sheets that are cut to length and fed into the subject collator.

Referring now to FIGS. 1–7, there is shown a preferred embodiment of a sheet collator. The subject collator comprises both hardware and software components and is configured to accept incoming sheets from an input device having at least one stream of sheets, separated into individual sheets before entry in the subject collator, and to deliver an assembled sheet packet to subsequent desired destinations. Each incoming sheet has a leading edge that enters the collator first and a trailing edge that enters the collator last. The subject collator assembles one or more sheets into a leading edge aligned, assembled packet (a common type of packet is a billing statement for a particular customer that may comprise a summary sheet and additional detail sheets), depending on the instructions delivered by a controlling system computer. The leading edge aligned, assembled packet is then sent on to post-processing equipment, such as an envelope inserter and the like.

Specifically, the subject collator 5 comprises a sheet collating tray 10 that includes two opposing side frame members 15 and 20. Linking the side frame members 15 and 20 are one (or more) support cross-member 25 that adds structural support to the tray 10 and provides anchoring points for drive mechanisms (see below). The support cross-member 25 may be fastened to the side members 15 and 20 by suitable means such as screws, bolts, welds, and the like. Towards the center of the tray, incoming sheets rest on support ribs 26 that generate the bottom of the tray. Each support rib 26 is anchored to a suitable location to provide structural stability. An end member 27 fastened to the side frame members 15 and 20 is acceptable, as is equivalent anchoring methods. To prevent any sheet within the collator tray from rubbing on a lower moving belt, the top edge of each support rib 26 is slightly above any lower belts found in this location. This design produces a "non-mark" collator tray that minimizes belt damage to the sheets.

Incorporated into in the subject tray 10 is a sheet-hold-down member 30 that is positionally adjustable for shorter or longer incoming sheets. The sheet-hold-down-member 30 is secured, by two side supports 35 and 40 and appropriate means such as screws, bolts 42 and 43, welds, and the like, to two adjustable side members 45 and 50. Each adjustable side member 45 and 50 is releasably fastened to an appropriate side frame member 15 and 20, respectively, by suitable means such as lever-fitted bolts 51, 52, 53, and 54 that mate with receiving apertures (not shown) in the side frame members 15 and 20. If a new length position is needed, the lever-fitted bolts 51, 52, 53, and 54 are loosened and the entire sheet-hold-down assembly (30 with 35 and 45 on one side and 40 and 50 on the other side) is moved/slid to a desired position, based on the length of the incoming sheet, and the lever-fitted bolts 51, 52, 53, and 54 are tightened to secure the selected new length position. Other equivalent releasable fastening structures are considered to be within the realm of this disclosure. Affixed to one side of the sheet-hold-down member 30 are first wheel-containing assembles 55 and 56 and to the other side of the sheet-hold-down member 30 are second wheel-containing assembly 60 (it is noted that additional first and second wheel-containing assemblies are within the realm of this disclosure). The orientation of the wheel-containing assembles 55 paired with 56 and 60 varies for the length of the incoming sheet with the paired 55 with 56 long wheel-containing assemblies oriented down for a long sheet and the short wheel-containing assembly 60 oriented down for a short sheet (in particular, see FIGS. 5, 6, and 7 for details and the two orientations). To invert the sheet-hold-down member 30, the sheet-hold-down member 30 is released by removing the retaining bolts 42 and flipping for the desired wheel-containing assembly 55/60 or 60/61 and then reattached the sheet-hold-down member 30 with the retaining bolts 42.

Width adjustable rails 65 and 70 are mounted along the insides of the side frame members 15 and 20 by means that permit narrowing or widening of the sheet path that exists between the rails 65 and 70. A common means for releasably securing each rail 15 and 20 is by means of lever-fitted bolts 71, 72, 73, and 74 that pass through apertures in the rails 65 and 70 and into receiving apertures in support brackets 76, 77, 78, and 79 affixed to the side frame members 15 and 20. An operator of the subject device loosens the lever-fitted bolts 71, 72, 73, and 74, repositions the rails 65 and 70 to match the width of the incoming sheet and then tightens the lever-fitted bolts 71, 72, 73, and 74.

Even though one member within each set of sheet downward-deflection finger members may be sufficient, usually, a plurality of sheet downward-deflection finger members 85 and 86 direct each incoming sheet to be in a generally flat or planar orientation within the tray 10 and between the adjustable width rails 65 and 70. The first set of sheet downward-deflection finger members 85 mount to a cross-member 87 that is attached at each end to a side frame member 15 and 20. The second set of sheet downward-deflection finger members 86 mount to a cross-member 88 that is attached at each end to an adjustable side member 45 and 50, thereby allowing the second set of sheet downward-deflection finger members 86 to move as the length of the tray 10 is altered.

In one embodiment of the subject invention comprises a plurality of belts 90 or similar devices are provided for assisting in removal of an aligned sheet packet from the collator tray. The belts 90 are driven via associated drive shafts 95 and wheels 100 that are coupled to suitable motors (not shown) and activated by the computer controller for the subject system. Each belt 10 has first end located proximate the entrance 105 to the tray 10 and a second end either located within the tray 10, distal to the tray entrance 105 and before the tray exit 110 or extending beyond the tray exit 110. As a sheet enters the tray 10 the sheet stays beneath the downward-deflection finger members 85 and 86 and on the support ribs 26 (not actually contacting a belt in this region until the aligned sheet packet is ejected from the tray). The forward motion of each sheet coming out of the sheet input device transports each sheet within the tray 10. Each sheet stops at the included sheet stop means.

The provided sheet stop means temporarily halts the progress of the incoming sheets until an entire set of sheets has arrived into the tray 10 (a set of sheets may be one or more sheets, as controlled by the computer controller for the system). The sheet stop means aligns the leading edges of the incoming sheets, thereby producing an aligned sheet packet that is then forwarded to subsequent processing equipment. Comprising the sheet stop means is a retractable stop plate 115 that is located proximate the distal second belt ends and a plate retracting first actuator 120 affixed the plate 115 via the actuator's sliding arm 121. In its extended position, the plate 115, which may have finger-like prongs, projects into the sheet path within the tray 10 and blocks the incoming sheets from exiting the tray 10 until directed by the computer controller to release the generated sheet packet. Upon activation by the computer controller, the plate retracting first actuator 120 retracts/lowers the plate 115, thereby removing the plate from the sheet pathway.

Figure 3A:
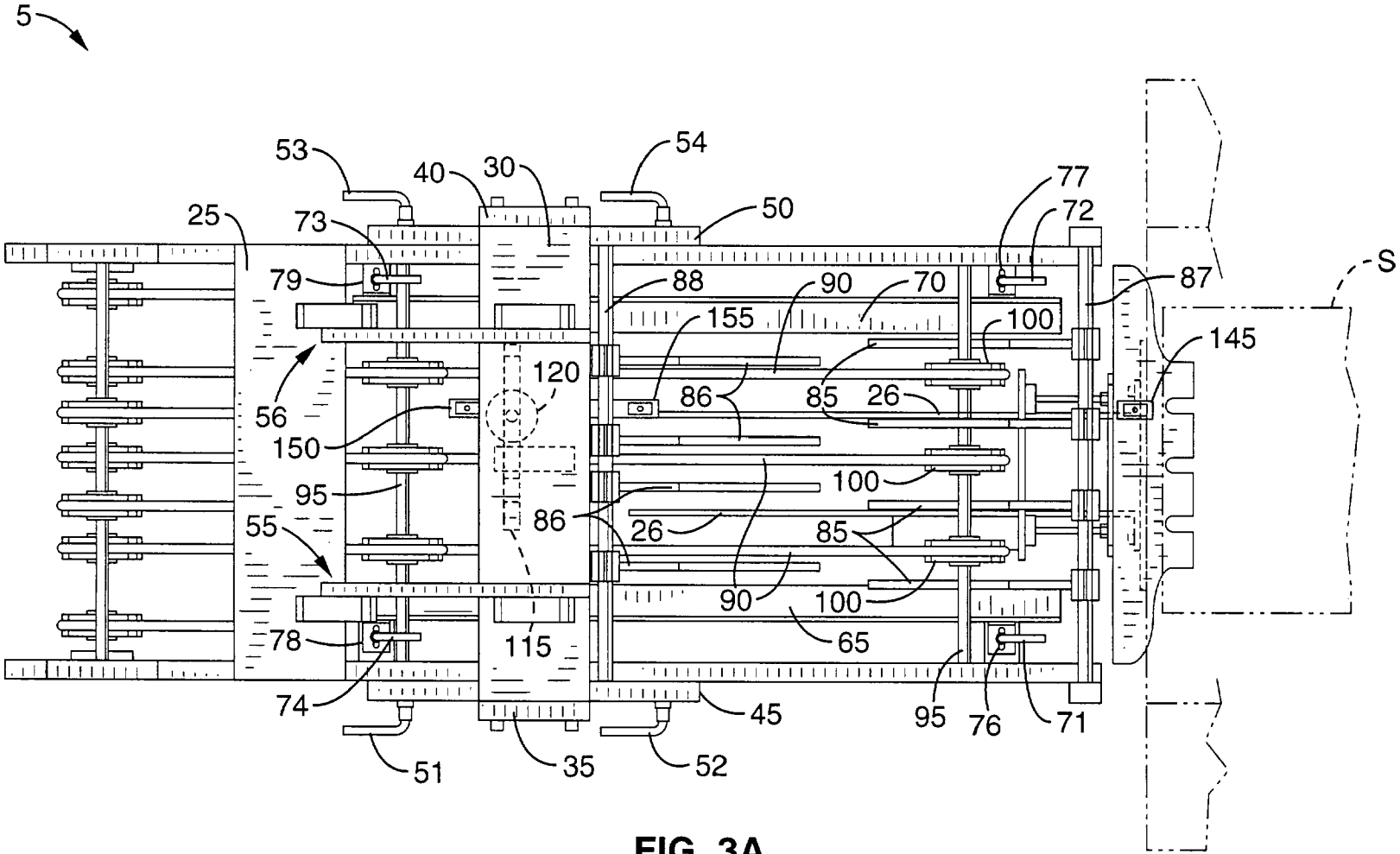
FIG. 3A is a top view of the subject collator showing a preceding cutter and a sheet about to enter the subject collator.
Figure 3B:
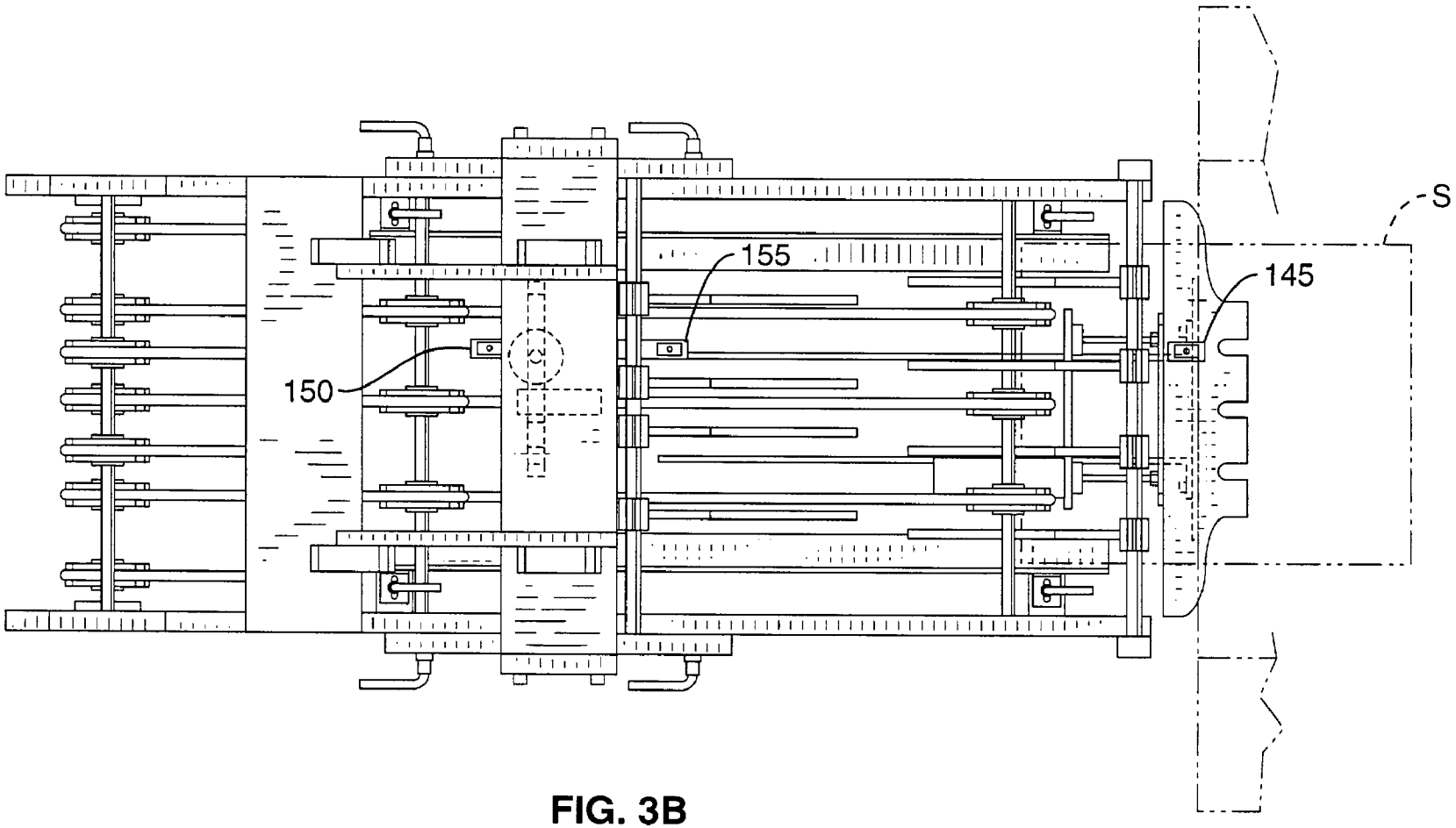
FIG. 3B is a top view of the subject collator showing a preceding cutter and a sheet that has partially passed into subject collator.
Figure 3C:
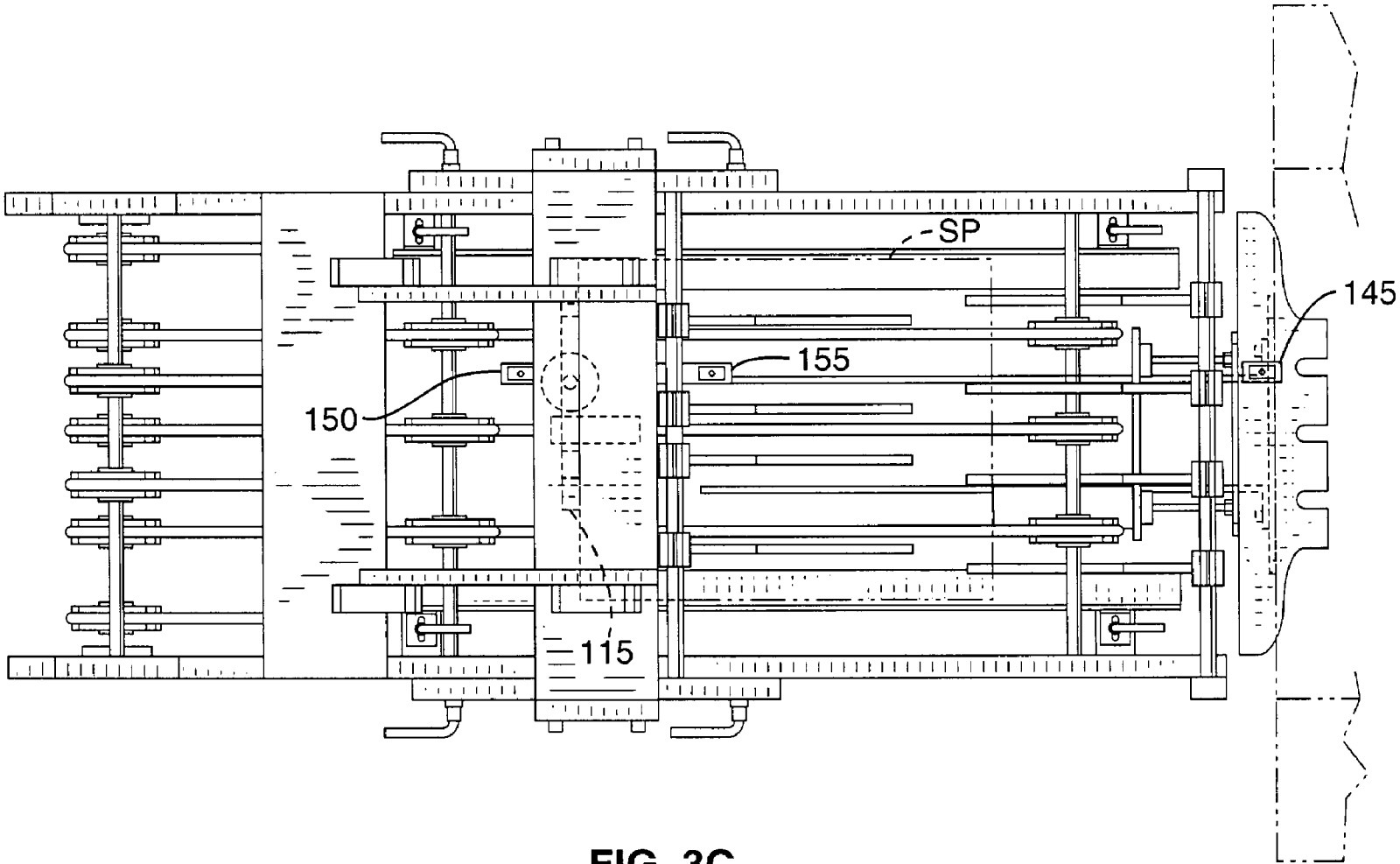
FIG. 3C is a top view of the subject collator showing a preceding cutter and a sheet fully in the tray of the subject collator.

The movement of one or more sheets through the subject tray 10 is illustrated in FIGS. 3A–3D. As seen in FIG. 3A, each sheet S enters the tray 10 from a prior input apparatus, with each sheet within the final sheet packet sent by the subject system's computer controller. FIG. 3B shows a sheet S partially within the tray 10 (see below for the use of sensors to follow the progress of each sheet). FIG. 3C depicts the aligned sheet packet SP, comprising one or more sheets S, that is totally within the tray 10 and aligned against the extended stop plate 115. When the entire required sheet packet SP is formed, the system computer controller retracts the stop plate 115, initiates the sheet kicker means, and transfers the sheet packet SP to subsequent processing equipment.

Figure 3D:
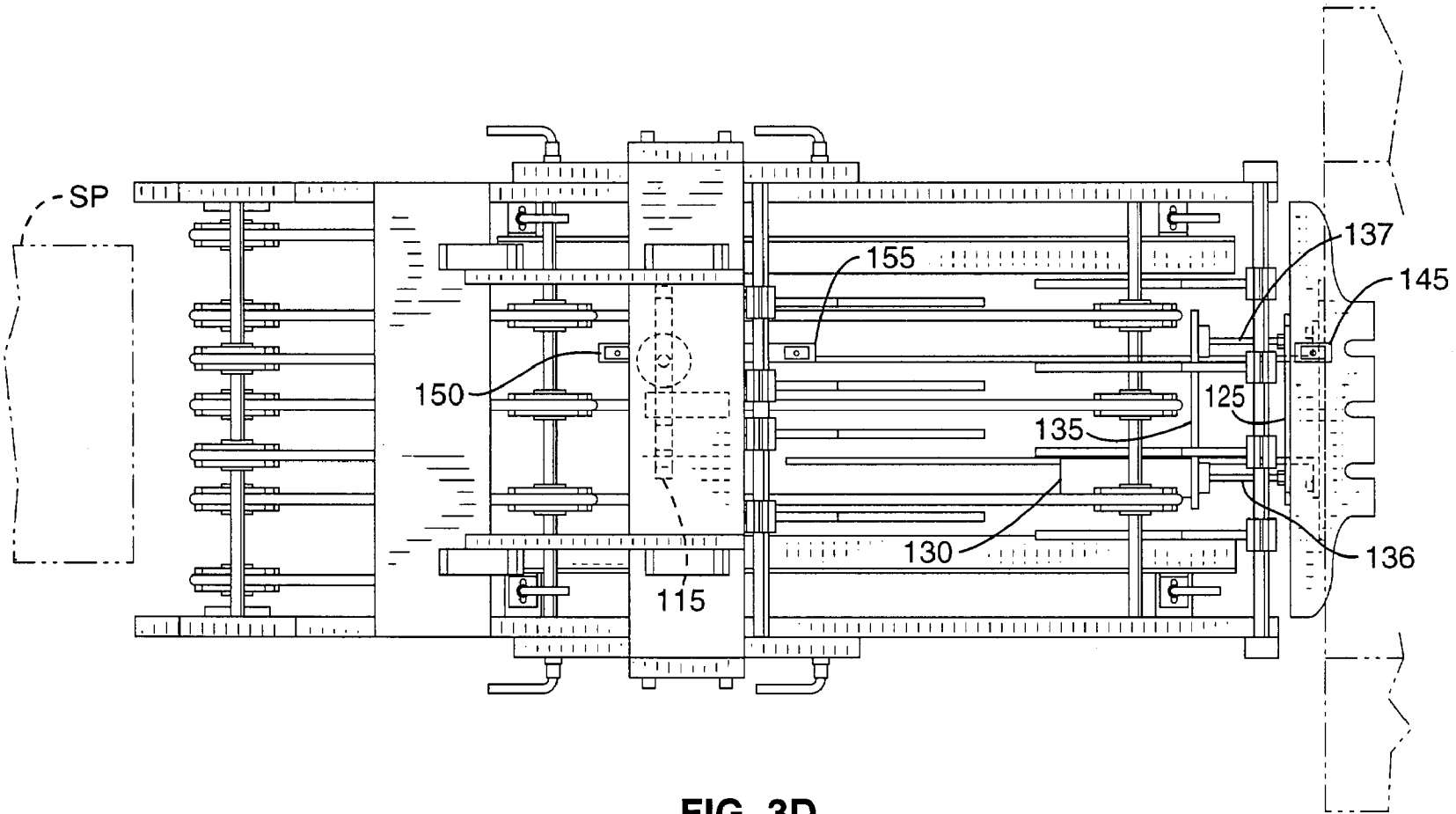
FIG. 3D is a top view of the subject collator showing a preceding cutter and a sheet or assembled packet exiting the subject collator.
Figure 4:
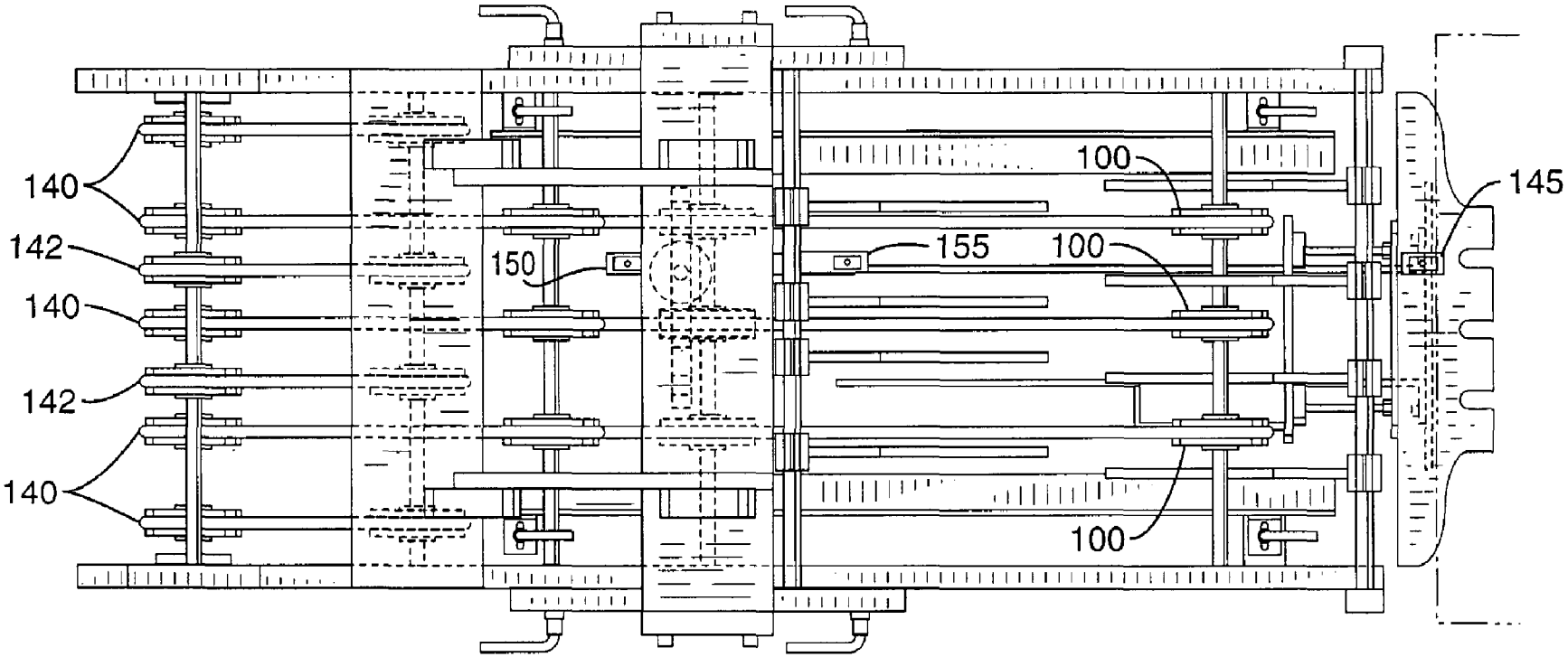
FIG. 4 is a top view of the subject collator showing the locations of the sheet transfer belts.
Figure 5:
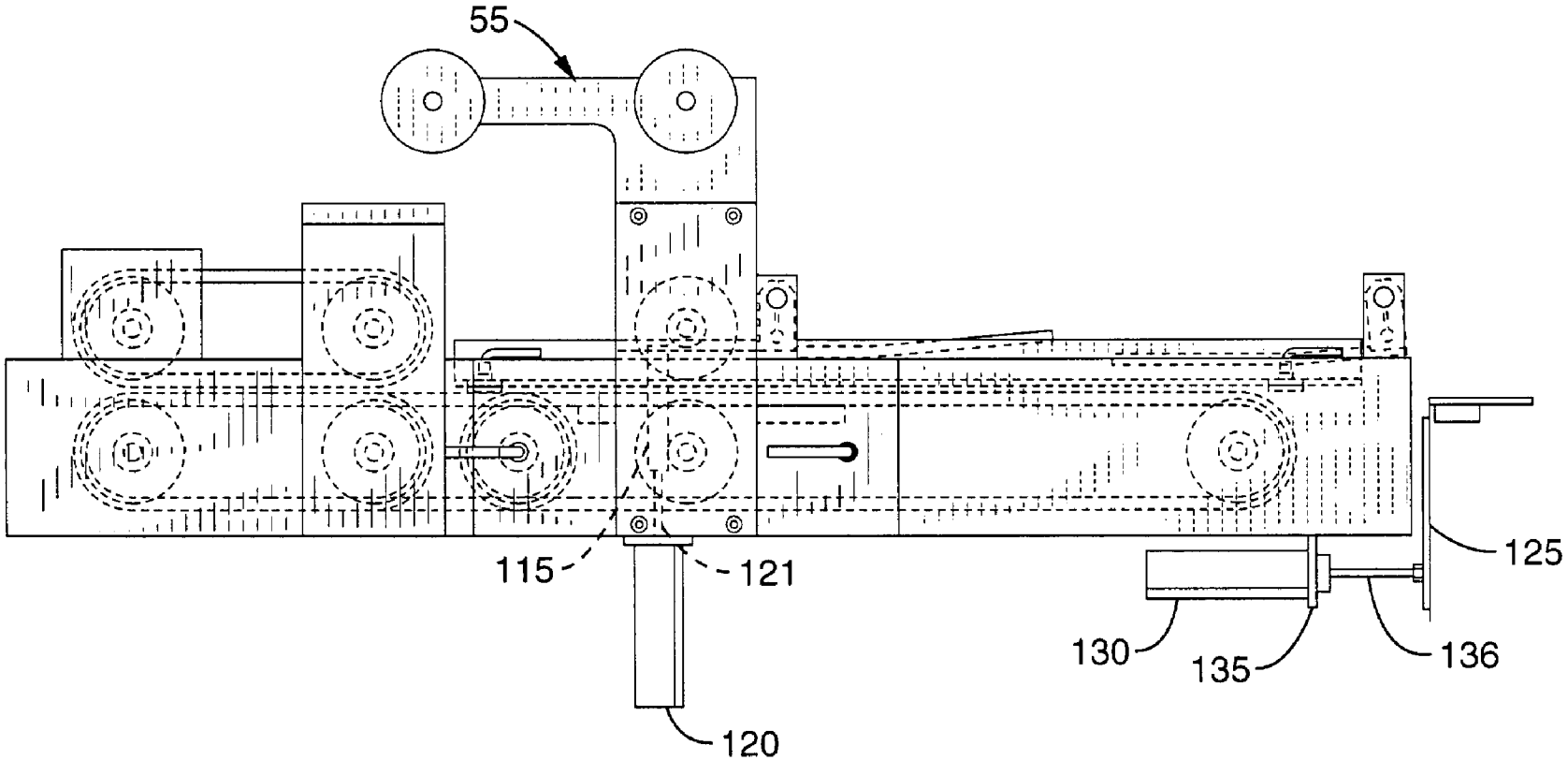
FIG. 5 is a side view of the subject collator showing the sheet-hold-down member in a first orientation.
Figure 6:
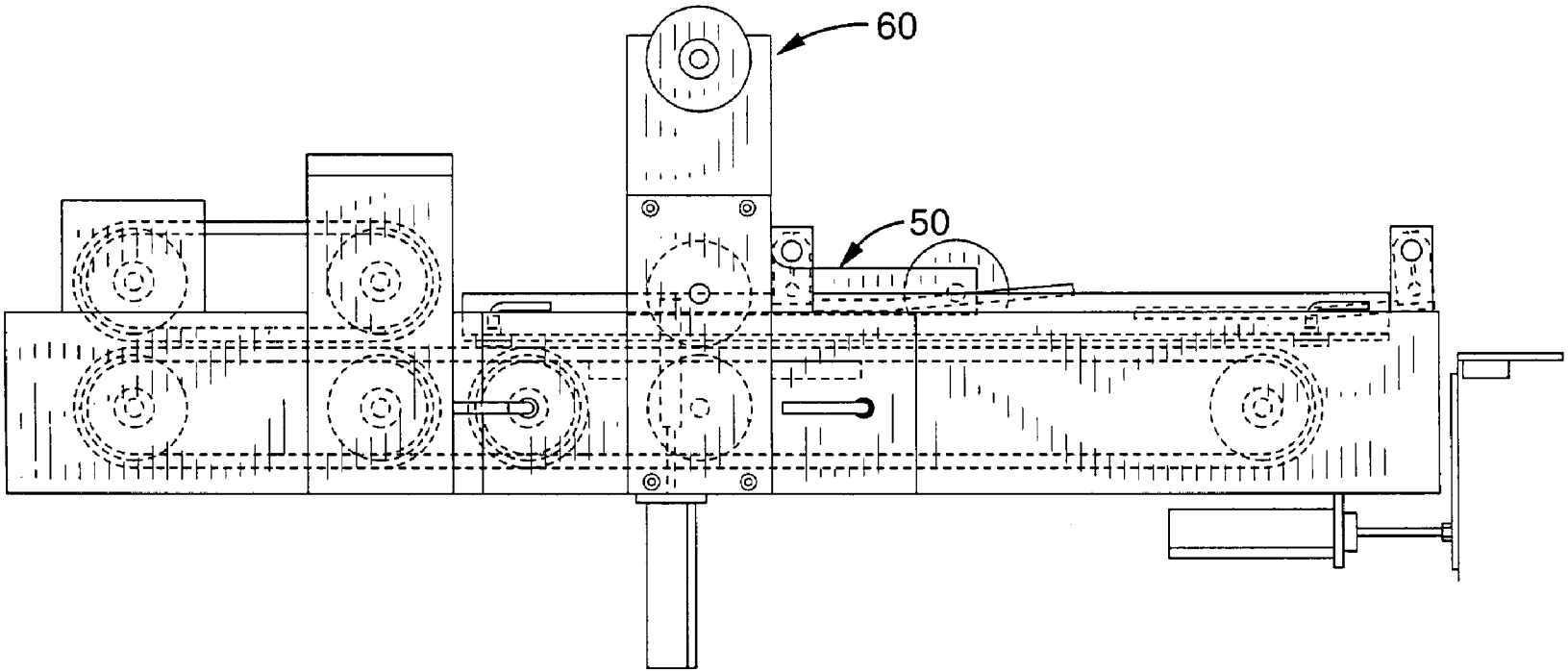
FIG. 6 is a side view of the subject collator showing the sheet-hold-down member in a second or flipped orientation, relative to the first orientation seen in FIG. 5.
Figure 7:
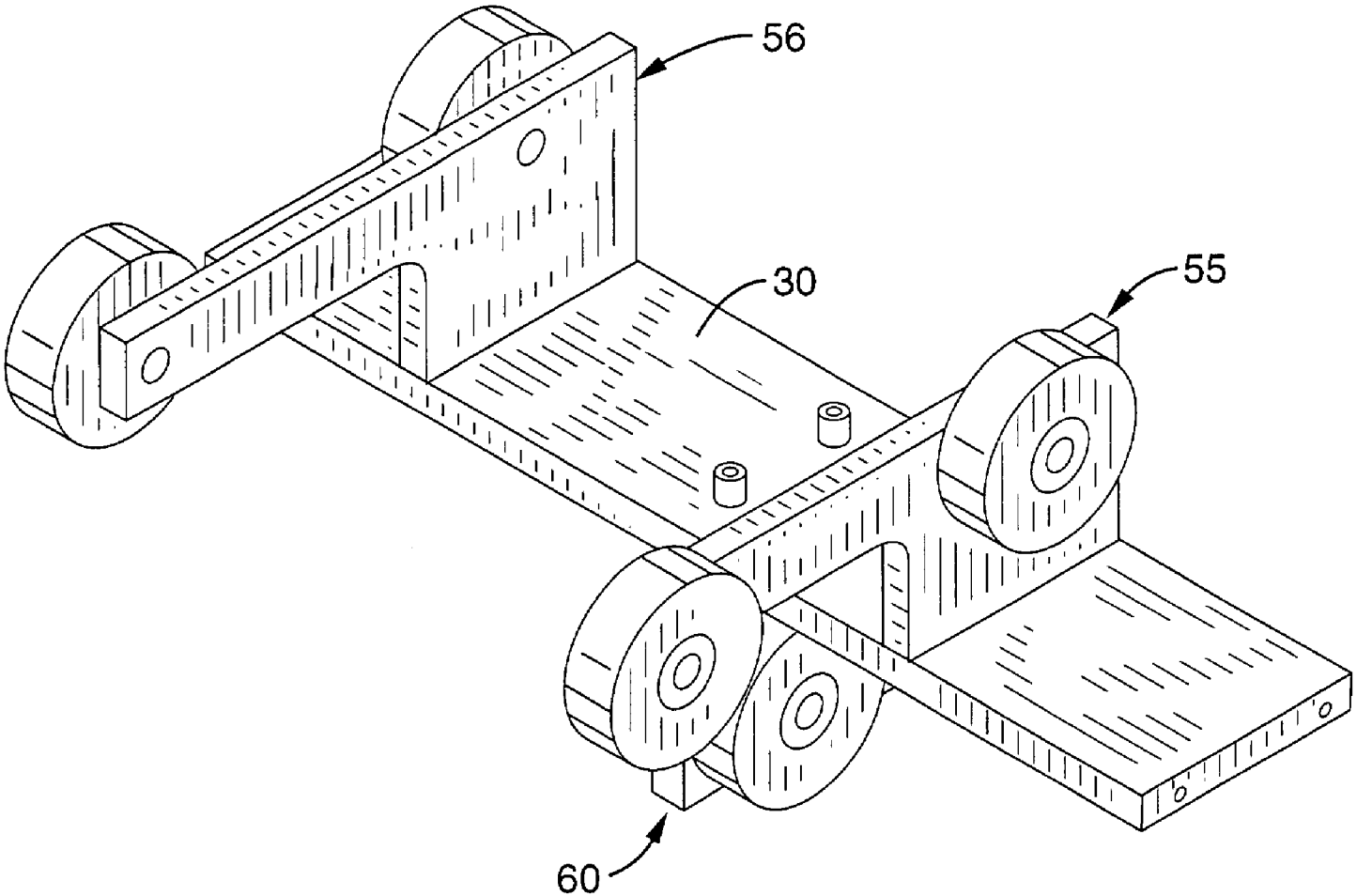
FIG. 7 is a perspective view of the sheet-hold-down member of the subject invention.

As seen in FIG. 3D, once the sheet stop plate 115 is retracted, the sheet kicker means, included in the subject device, initiates the transfer of the aligned sheet packet SP from the tray 10. The sheet kicker means comprises a kicker plate 125 that is mounted proximate the tray entrance 105 to a second actuator 130 via the second actuator's sliding arm 136 and supported by a bracket 135 affixed to a lower portion of the tray 10. Usually, a second supporting and sliding arm member 137 helps guide the movement of the kicker plate 125. When each system computer controlled sheet packet SP is assembled in the tray 10 and against the stop plate 115, the computer retracts the stop plate 115 (via activation of the first actuator 120) and activates the second kicker plate actuator 130. The attached kicker plate 125 forces the aligned sheet packet SP past the lowered stop plate 115 and into the associated sheet packet transfer means.

Comprising the sheet packet transfer means for delivering the aligned sheet packet SP from the tray 10 to downstream processing equipment is a plurality of sheet packet-grasping belts 90, 140, and 142. Aligned sheet packets are sandwiched between a plurality of lower belts 90 and 140 and upper belts 142. When the stop plate 115 is retracted by the system controller the kicker plate 125 is activated to eject each aligned sheet packet into the paired packet-grasping belts 90, 140, and 142.

The entire collating system is controlled by a computer-facilitated means that optimizes the operational timing of the collator and for monitoring sheet progress through the collator, including sheet entry into the sheet collating tray 10, presence of one or more sheets within the sheet collating tray 10, and the aligned sheet packet departure from the sheet collating tray 10 (see FIGS. 3A–3D and the following description for the details of the sheet monitoring process).

The computer-facilitated means comprises now known or later developed electronic computer hardware and software that is interfaced with the collator and surrounding sheet processing equipment and controls the overall sheet handling steps, including, but not limited to: sheet presence or absence, sheet position, errors in sheet packet content, and the like. The controlling computer monitors the subject collator in relation to upstream and downstream sheet handling components to provide an environment in which correctly assembled sheet-packets are collected, assembled, inserted into envelopes, along with any selected inserts, and transported to a final destination.

Specifically in terms of the controlling computer's ability to direct the operation of the subject collator, programming is included that optimizes the operational timing of the collator and for monitoring sheet progress through the collator. The programming controls the sheet transfer means, the sheet stop means, the sheet kicker means, and the packet transfer means. Additionally, sensor means are mounted to the subject collator and coupled to the computer means for detecting sheet progress through the subject devise, wherein the computer regularly monitors if each sensor is open or blocked by a sheet.

More specifically, the subject system utilizes three computer-interfaced sensors 145, 150, and 155 to monitor sheets of paper flowing into and out of the collator. The sensors may be of any suitable now know or later developed design and are usually fiber-optic sensors, or the equivalent, that detect reflected or transmitted light as a sheet passes its location. These sensors 145, 150, and 155 are configured to output two distinct electrical states. One state indicates to the collator computer means that no sheet is present and the other state indicates that a sheet is present. The sensors 145, 150, and 155 are arranged to allow optimal timing in the actuation of the collator's output delivery mechanisms and to allow monitoring of the collator's contents for quality/error assurance purposes.

Specifically, a first or "input" sensor 145 is included in the subject system. The input sensor 145 is located proximate the input edge or tray entrance 105 of the collator. As a sheet S begins to enter the collator, the input sensor 145 notifies the collator computer software of the position of the leading edge of the sheet S. The software verifies the timing of this edge and begins to track the sheet S into the collator. The leading edge of the sheet S is expected within some specified window of time. Also, the trailing edge of the sheet S is expected within some specified window of time from the leading edge. If the sheet S does not clear the sensor 145 within the expected time, then a paper jam has occurred and the software takes appropriate action The appropriate action is sending a system stop message to the system controller, displaying a descriptive error message, and setting an indicator that the collator can not run until each of the three sensors 145, 150, and 155 shows no paper present. If the trailing edge of the sheet S occurs too quickly, then a spurious piece of paper (e.g. paper trim, a short sheet, or the like) has entered the collator and the software takes appropriate action. The appropriate action is sending a system stop message to the system controller, displaying a descriptive error message, and setting an indicator that the collator can not run until each of the three sensors 145, 150, and 155 shows no paper present.

A second or "output" sensor 150 is included in the subject system. The output sensor 150 is located at the output edge or tray exit 110 of the subject collator. As a collated and aligned sheet packet SP (with one or more sheets S) begins to exit the collator the output sensor 150 notifies the collator computer software of the position of the leading edge of the sheet packet SP. The software verifies the timing of this edge and begins to track the sheet packet SP out of the subject collator. The leading edge of the sheet packet SP is expected within some specified window of time. Also, the trailing edge of the sheet packet SP is expected with some specified window of time from the leading edge. If the sheet packet SP does not clear the sensor 150 within the expected time, then a paper jam has occurred and the software takes appropriate action. The appropriate action is sending a system stop message to the system controller, displaying a descriptive error message, and setting an indicator that the collator can not run until each of the three sensors 145, 150, and 155 shows no paper present. If the trailing edge of the sheet packet SP occurs too quickly, then a spurious event has occurred and the software takes appropriate action. The appropriate action is sending a system stop message to the system controller, displaying a descriptive error message, and setting an indicator that the collator can not run until each of the three sensors 145, 150, and 155 shows no paper present.

A third or "internal" sensor 155 is included in the subject system. The internal sensor 155 is located at a suitable position within the collator such as proximate the sheet-hold-down member 30 or equivalent location. This sensor 155 detects the presence of a sheet S when the first sheet of a sheet packet SP has entered the collator and the sheet must be present at an expected time or an error is noted. When a completed sheet packet SP exits the collator, the collator software expects the internal sensor 155 to indicate that no sheets are present. If the sensor 155 continues to indicate that any sheet is present when the sheet packet SP has supposedly exited, then one or more sheets have been left behind in the collator (which is a quality failure) and the software takes appropriate action. The appropriate action is sending a system stop message to the system controller, displaying a descriptive error message, and setting an indicator that the collator can not run until each of the three sensors 145, 150, and 155 shows no paper present.

The placement of the collator sensors allows optimal timing in the actuation of the output delivery mechanism. Because the input sensor 145 is always located at the input edge 105 of the collator, the collator's output mechanism may be actuated immediately after the sensor 145 detects the trailing edge of a sheet packet's last sheet. The output sensor 150 is attached to the collator's output edge 110 and always has the same timing relationship with respect to the leading edge of a sheet packet SP that is exiting from the collator.

More specifically, the subject collator's software utilizes decision logic to facilitate sheet collation and transfer and responds to various input events. The subject processing logic achieves the following purposes:

1. Verifies that each sheet sent by the upstream device enters the collator within an expected timing window.
2. Insures that only complete, correct sheet packets are delivered from the collator to a downstream device.
3. Insures that no sheets are left behind when a sheet packet is delivered from the collator.
4. Insures that the output mechanisms of the collator are actuated immediately upon arrival of the last sheet of a sheet packet.
5. Insures that a fault indication is displayed on a suitable user interface whenever the contents of the collator are unknown or invalid.
6. Insures that the measured length of the output stack of sheets (sheet packet) matches the individual sheet length to within a specified tolerance, or failing such a match, insures the output sheet packet is diverted for operator inspection.

The following table indicated critical decision logic steps that are employed during operation of the subject collator.

Decision Logic Steps

| Event | Generated by | Control Logic |
|---|---|---|
| Sheet Sent Message | Upstream device feeding sheets | Verify one of the following is true:<br>a. The sheet is the first sheet of a sheet packet and the collator is currently empty.<br>b. The sheet number is adjacent to the top sheet currently contained in the collator and belongs to the same sheet packet.<br>Provided one of these conditions is verified, establish timing window for arrival of a physical sheet to be detected at the input sensor.<br>If neither condition is true, display an error message and declare the contents of the collator to be invalid.<br>Indicate a faulted state on the user interface. |
| Input Sensor Break | Input Sensor | If the break falls within the expected timing window, establish a timing window for the sensor to clear. |
| Input Sensor Break Timeout | Computer's internal timing device | Display an error message and declare the contents of the collator to be unknown.<br>Indicate a faulted state on the user interface |
| Input Sensor Clear | Input Sensor | If the time falls within the expected timing window, update the data representing the contents of the collator to include the new sheet.<br>If the contents of the collator now represent a completed sheet packet actuate the stopper and kicker means to convey the contents of the collator forward, and send a message to the receiving device.<br>Establish a timing window for the detection of the outgoing sheet packet at the collator's output sensor.<br>Establish a point in time to read the collator's internal sensor to verify no sheets have been left behind. |
| Input Sensor Clear Timeout | Computer's internal timing device | Display an error message and declare the contents of the collator to be unknown.<br>Indicate a faulted state on the user interface |

-continued

Decision Logic Steps

| Event | Generated by | Control Logic |
|---|---|---|
| Output Sensor Break | Output sensor | Read the transport control position to establish the displacement of the collator's drive motor at the time of the sensor break. Establish a timing window for the output sensor to clear. |
| Output Sensor Break Timeout | Computer's internal timing device | Display an error message and declare the contents of the collator to be unknown. Indicate faulted state on the user interface |
| Internal sensor read time | Computer's internal timing device | Read the state of the internal sensor. If the internal sensor is blocked, display an error message and declare the contents of the collator to be unknown. Indicate faulted state on the user interface If the internal sensor is clear indicate that the collator is now empty. |
| Output Sensor Clear | Output sensor | Read the transport control position to establish the displacement of the motor at the time of the sensor clear. Subtract the displacement at the time of the output sensor break to determine the total displacement while the sensor was blocked. If the total displacement exceeds the length of the sheets being collated by more than a fixed parameter update the information representing the sheet packet to indicate the sheet packet is "shingled" so that the statement can be diverted for operator attention. |
| Output Sensor Clear Timeout | Computer's internal timing device | Display an error message and declare the contents of the collator to be unknown. Indicate faulted state on the user interface. |
| Internal sensor polling interval | Computer's internal timing device | Read the internal sensor. If the sensor shows clear indicate the collator is empty, removed the fault indication on the user interface. If the sensor shows blocked, indicate a faulted state on the user interface and declare the contents of the collator to be unknown. |

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A collator for assembling a packet from one or more sheets, comprising:

a) a sheet collating tray having an entrance and an exit, wherein said sheet collating tray is adjustable to accommodate variable width and length sheets;

b) an invertible and sheet-length adjustable sheet-hold-down assembly having a first shorter-sheet orientation and an inverted second longer-sheet orientation releasably incorporated into said sheet collating tray for accommodating variable length sheets in both said first shorter-sheet and said second longer-sheet orientations;

c) sheet stop means within said sheet collating tray and proximate said collating tray exit for stopping and aligning a leading edge of each sheet entering said sheet collating tray, thereby producing an aligned sheet packet;

d) sheet kicker means proximate said collator tray entrance for initiating output of said aligned sheet packet from said sheet collating tray;

e) packet transfer means for delivering from said collating tray each said aligned sheet packet to downstream processing equipment; and f) computer-facilitated means for optimizing operational timing of the collator and for monitoring sheet progress through the collator, including entry into said sheet collating tray, presence of one or more sheets within said sheet collating tray, and said aligned sheet packet departure from said sheet collating tray.

2. A collator according to claim 1, wherein said collating tray comprises:

a) first and second side frame members;

b) one or more support cross-members linking said first and said second side frame members; and c) first and second side rails, wherein said first side rail is adjustably mounted proximate said first side frame member and said second side rail is adjustably mounted proximate said second side frame member.

3. A collator according to claim 2, wherein said collating tray further comprises one or more support ribs upon which incoming sheets set, wherein each of said support ribs has a first end proximate said collating tray entrance and a second end proximate said collating tray exit.

4. A collator according to claim 2, wherein said sheet stop means comprises:

a) a retractable stop plate forming a distal end to said collator tray and b) a first actuator affixed to said stop plate, wherein said first actuator retracts and extends said stop plate, wherein when said stop plate is extended said leading edge of each sheet aligns against said stop plate and when said stop plate is retracted said aligned sheet packet may exit said collating tray.

5. A collator according to claim 4, wherein said sheet kicker comprises:

a) a kicker plate mounted proximate said collating tray entrance and b) a second actuator attached to said kicker plate, wherein when said stop plate is retracted said second actuator is activated to eject said aligned sheet packet from within said collating tray.

6. A collator according to claim 1, wherein said packet transfer means comprises a plurality of sheet packet-grasping upper and lower belts positioned proximate said sheet stop means and between which said aligned sheet packet exits to said downstream processing equipment.

7. A collator according to claim 1, wherein said computer-facilitated means for optimizing operational timing of the collator and for monitoring sheet progress through the collator comprises:

a) a computer means in communication with the collator;

b) programming in said computer means for optimizing operational timing of the collator and for monitoring sheet progress through the collator, wherein said programming controls said sheet stop means, said sheet kicker means, and said packet transfer means; and c) sensor means mounted to said collator and coupled to said computer means for detecting sheet progress through the collator.

8. A collator according to claim 7, wherein said sensor means comprises a plurality of sheet detecting devices, wherein said plurality of sheet detecting devices monitors sheet progress through the collator, including entry into said sheet collating tray, presence of one or more sheets within said sheet collating tray, and said aligned sheet packet departure from said sheet collating tray.

9. A collator according to claim 7, wherein said sensor means comprises:

a) an input sensor located proximate said sheet kicker means of the collator, wherein said input sensor notifies said computer means of the entry of a sheet into the collator;

b) an output sensor located proximate said sheet stop means of the collator, wherein said output sensor notifies said computer means that said aligned packet is starting to exit the collator; and c) an internal sensor located between said sheet kicker means and said sheet stop means of the collator, wherein said internal sensor notifies said computer means that no sheet remains within the collator after said aligned sheet packet exits the collator and before one or more sheets for a new packet arrive.

10. A collator for assembling a packet from one or more sheets, comprising:

a) a sheet collating tray having an entrance and an exit and is adjustable to accommodate variable width and length sheets, wherein said collating tray comprises:

i) first and second side frame members;

ii) one or more support cross-members linking said first and said second side frame members;

iii) first and second side rails, wherein said first side rail is adjustably mounted proximate said first side frame member and said second side rail is adjustably mounted proximate said second side frame member; and iv) one or more support ribs upon which incoming sheets set, wherein each of said support ribs has a first end proximate said collating tray entrance and a second end proximate said collating tray exit;

b) an invertible and sheet-length adjustable sheet-hold-down assembly having a first shorter-sheet orientation and an inverted second longer-sheet orientation releasably incorporated into said sheet collating tray for accommodating variable length sheets in both said first shorter-sheet and said second longer-sheet orientations;

c) sheet stop means within said sheet collating tray forming a distal end to said collator tray for stopping and aligning a leading edge of each sheet entering said sheet collating tray, thereby producing an aligned sheet packet;

d) sheet kicker means proximate said collator tray entrance for initiating output of said aligned sheet packet from said sheet collating tray;

e) packet transfer means for delivering from said collating tray each said aligned sheet packet to downstream processing equipment; and f) computer-facilitated means for optimizing operational timing of the collator and for monitoring sheet progress through the collator, including entry into said sheet collating tray, presence of one or more sheets within said sheet collating tray, and said aligned sheet packet departure from said sheet collating tray.

11. A collator according to claim 10, wherein said sheet stop means comprises:

a) a retractable stop plate and b) a first actuator affixed to said stop plate, wherein said first actuator retracts and extends said stop plate, wherein when said stop plate is extended said leading edge of each sheet aligns against said stop plate and when said stop plate is retracted said aligned sheet packet may exit said collating tray.

12. A collator according to claim 11, wherein said sheet kicker comprises:

a) a kicker plate mounted proximate said collator tray entrance and b) a second actuator attached to said kicker plate, wherein when said stop plate is retracted said second actuator is activated to eject said aligned sheet packet from within said collating tray.

13. A collator according to claim 10, wherein said packet transfer means comprises a plurality of sheet packet-grasping belts positioned after said sheet stop means and between which said aligned sheet packet exits to said downstream processing equipment.

14. A collator according to claim 10, wherein said computer-facilitated means for optimizing operational timing of the collator and for monitoring sheet progress through the collator comprises:

a) a computer means in communication with the collator;

b) programming in said computer means for optimizing operational timing of the collator and for monitoring sheet progress through the collator, wherein said programming controls said sheet stop means, said sheet kicker means, and said packet transfer means; and c) sensor means mounted to said collator and coupled to said computer means for detecting sheet progress through the collator, wherein said computer means regularly monitors if said sensor means is in an open or sheet-blocked state.

15. A collator according to claim 14, wherein said sensor means comprises a plurality of sheet detecting devices, wherein said plurality of sheet detecting devices monitors sheet progress through the collator, including entry into said sheet collating tray, presence of one or more sheets within said sheet collating tray, and said aligned sheet packet departure from said sheet collating tray.

16. A collator according to claim 14, wherein said sensor means comprises:

a) an input sensor located proximate said sheet kicker means of the collator, wherein said input sensor notifies said computer means of the entry of a sheet into the collator;

b) an output sensor located proximate said sheet stop means of the collator, wherein said output sensor notifies said computer means that said aligned packet is starting to exit the collator; and c) an internal sensor located between said sheet kicker means and said sheet stop means of the collator, wherein said internal sensor notifies said computer means that no sheet remains within the collator after said aligned sheet packet exits the collator and before one or more sheets for a new packet arrive.

17. A collator for assembling a packet from one or more sheets, comprising:

a) a sheet collating tray adjustable to accommodate variable width and length sheets and having an entrance and an exit, wherein said collating tray comprises:

i) first and second side frame members;

ii) one or more support cross-members linking said first and said second side frame members;

iii) first and second side rails, wherein said first side rail is adjustably mounted proximate said first side frame member and said second side rail is adjustably mounted proximate said second side frame member; and iv) one or more support ribs upon which incoming sheets set, wherein each of said support ribs has a first end proximate said collating tray entrance and a second end proximate said collating tray exit;

b) an invertible and sheet-length adjustable sheet-hold-down assembly having a first shorter-sheet orientation and an inverted second longer-sheet orientation releasably incorporated into said sheet collating tray for accommodating variable length sheets in both said first shorter-sheet and said second longer-sheet orientations;

c) sheet stop means forming a distal end said sheet collating tray for stopping and aligning a leading edge of each sheet entering said sheet collating tray, thereby producing an aligned sheet packet, wherein said sheet stop means comprises:

i) a retractable stop plate mounted proximate said collator tray exit and ii) a first actuator affixed to said stop plate, wherein said first actuator retracts and extends said stop plate, wherein when said stop plate is extended said leading edge of each sheet aligns against said stop plate and when said stop plate is retracted said aligned sheet packet may exit said collating tray;

d) sheet kicker means proximate said collator tray entrance for initiating output of said aligned sheet packet from said sheet collating tray, wherein said sheet kicker comprises:

i) a kicker plate mounted proximate said collator tray entrance and ii) a second actuator attached to said kicker plate, wherein when said stop plate is retracted said second actuator is activated to eject said aligned sheet packet from within said collating tray;

e) packet transfer means for delivering from said collating tray each said aligned sheet packet to downstream processing equipment, wherein said packet transfer means comprises a plurality of sheet packet-grasping belts positioned after said sheet stop means and between which said aligned sheet packet exits to said downstream processing equipment; and f) computer-facilitated means for optimizing operational timing of the collator and for monitoring sheet progress through the collator, including entry into said sheet collating tray, presence of one or more sheets within said sheet collating tray, and said aligned sheet packet departure from said sheet collating tray.

18. A collator according to claim 17, wherein said computer-facilitated means for optimizing operational timing of the collator and for monitoring sheet progress through the collator comprises:

a) a computer means in communication with the collator;

b) programming in said computer means for optimizing operational timing of the collator and for monitoring sheet progress through the collator, wherein said programming controls said sheet stop means, said sheet kicker means, and said packet transfer means; and c) sensor means mounted to said collator and coupled to said computer means for detecting sheet progress through the collator, wherein said computer means regularly monitors if said sensor means is in an open or sheet-blocked state.

19. A collator according to claim 18, wherein said sensor means comprises a plurality of sheet detecting devices, wherein said plurality of sheet detecting devices monitors sheet progress through the collator, including entry into said sheet collating tray, presence of one or more sheets within said sheet collating tray, and said aligned sheet packet departure from said sheet collating tray.

20. A collator according to claim 18, wherein said sensor means comprises:

a) an input sensor located proximate said sheet kicker means of the collator, wherein said input sensor notifies said computer means of the entry of a sheet into the collator;

b) an output sensor located proximate said sheet stop means of the collator, wherein said output sensor notifies said computer means that said aligned packet is starting to exit the collator; and c) an internal sensor located between said sheet kicker means and said sheet stop means of the collator, wherein said internal sensor notifies said computer means that no sheet remains within the collator after said aligned sheet packet exits the collator and before one or more sheets for a new packet arrive.

21. A collator for assembling a packet from one or more sheets, comprising:

a) a sheet collating tray adjustable to accommodate variable width and length sheets and having an entrance and an exit, wherein said collating tray comprises:

i) first and second side frame members;

ii) one or more support cross-members linking said first and said second side frame members;

iii) first and second side rails, wherein said first side rail is adjustably mounted proximate said first side frame member and said second side rail is adjustably mounted proximate said second side frame member; and iv) one or more support ribs upon which incoming sheets set, wherein each of said support ribs has a first end proximate said collating tray entrance and a second end proximate said collating tray exit;

b) an invertible and sheet-length adjustable sheet-hold-down assembly having a first shorter-sheet orientation and an inverted second longer-sheet orientation releasably incorporated into said sheet collating tray for accommodating variable length sheets in both said first shorter-sheet and said second longer-sheet orientations;

c) sheet stop means within said sheet collating tray for stopping and aligning a leading edge of each sheet entering said sheet collating tray, thereby producing an aligned sheet packet, wherein said sheet stop means comprises:

i) a retractable stop plate forming a distal end for said collator tray and ii) a first actuator affixed to said stop plate, wherein said first actuator retracts and extends said stop plate, wherein when said stop plate is extended said leading edge of each sheet aligns against said stop plate and when said stop plate is retracted said aligned sheet packet may exit said collating tray;

d) sheet kicker means for initiating output of said aligned sheet packet from said sheet collating tray, wherein said sheet kicker comprises:

i) a kicker plate mounted proximate said collator tray entrance and ii) a second actuator attached to said kicker plate, wherein when said stop plate is retracted said second actuator is activated to eject said aligned sheet packet from within said collating tray;

e) packet transfer means for delivering from said collating tray each said aligned sheet packet to downstream processing equipment, wherein said packet transfer means comprises a plurality of sheet packet-grasping belts positioned after said sheet stop means and between which said aligned sheet packet exits to said downstream processing equipment; and f) computer-facilitated means for optimizing operational timing of the collator and for monitoring sheet progress through the collator, including entry into said sheet collating tray, presence of one or more sheets within said sheet collating tray, and said aligned sheet packet departure from said sheet collating tray, wherein said computer-facilitated means for optimizing operational timing of the collator and for monitoring sheet progress through the collator comprises:

i) a computer means in communication with the collator;

ii) programming in said computer means for optimizing operational timing of the collator and for monitoring sheet progress through the collator, wherein said programming controls said sheet stop means, said sheet kicker means, and said packet transfer means; and iii) sensor means mounted to said collator and coupled to said computer means for detecting sheet progress through the collator, wherein said computer means regularly monitors if said sensor means is in an open or sheet-blocked state.

22. A collator according to claim 21, wherein said sensor means comprises a plurality of sheet detecting devices, wherein said plurality of sheet detecting devices monitors sheet progress through the collator, including entry into said sheet collating tray, presence of one or more sheets within said sheet collating tray, and said aligned sheet packet departure from said sheet collating tray.

23. A collator according to claim 21, wherein said sensor means comprises:

a) an input sensor located proximate said sheet kicker means of the collator, wherein said input sensor notifies said computer means of the entry of a sheet into the collator;

b) an output sensor located proximate said sheet stop means of the collator, wherein said output sensor notifies said computer means that said aligned packet is starting to exit the collator; and c) an internal sensor located between said sheet kicker means and said sheet stop means of the collator, wherein said internal sensor notifies said computer means that no sheet remains within the collator after said aligned sheet packet exits the collator and before one or more sheets for a new packet arrive.

24. A collator for assembling a packet from one or more sheets, comprising:

a) a sheet collating tray having an entrance and an exit comprising;

i) a pair of opposing side members that are adjustable for receiving sheets of variable width;

ii) adjustable length means for receiving sheets of variable length, wherein said adjustable length means includes a sheet-hold-down member that is positioned is a first orientation for shorter sheets and in a second orientation for longer sheets; and iii) one or more support ribs upon which incoming sheets set, wherein each of said support ribs has a first end proximate said collating tray entrance and a second end proximate said collating tray exit;

b) an invertible sheet-hold-down assembly releasably incorporated into said sheet collating tray for accommodating variable length sheets, comprising:

i) first wheel containing assemblies affixed to a first side of said sheet-hold-down assembly and ii) a second wheel containing assembly affixed to a second side of said sheet-hold-down assembly;

c) sheet stop means within said sheet collating tray for stopping and aligning a leading edge of each sheet entering said sheet collating tray, thereby producing an aligned sheet packet, wherein said sheet stop means comprises:

i) a retractable stop plate mounted proximate said collator tray exit and ii) a first actuator affixed to said stop plate, wherein said first actuator retracts and extends said stop plate, wherein when said stop plate is extended said leading edge of each sheet aligns against said stop plate and when said stop plate is retracted said aligned sheet packet may exit said collating tray;

d) sheet kicker means for initiating output of said aligned sheet packet from said sheet collating tray, wherein said sheet kicker comprises:

i) a kicker plate mounted proximate said collator tray entrance and ii) a second actuator attached to said kicker plate, wherein when said stop plate is retracted said second actuator is activated to eject said aligned sheet packet from within said collating tray;

e) packet transfer means for delivering from said collating tray each said aligned sheet packet to downstream processing equipment, wherein said packet transfer means comprises a plurality of sheet packet-grasping belts positioned after said sheet stop means and between which said aligned sheet packet exits to said downstream processing equipment; and f) computer-facilitated means for optimizing operational timing of the collator and for monitoring sheet progress through the collator, including entry into said sheet collating tray, presence of one or more sheets within said sheet collating tray, and said aligned sheet packet departure from said sheet collating tray, wherein said computer-facilitated means for optimizing operational timing of the collator and for monitoring sheet progress through the collator comprises:

i) a computer means in communication with the collator;

ii) programming in said computer means for optimizing operational timing of the collator and for monitoring sheet progress through the collator, wherein said programming controls said sheet stop means, said sheet kicker means, and said packet transfer means; and iii) sensor means mounted to said collator and coupled to said computer means for detecting sheet progress through the collator, wherein said computer means regularly monitors if said sensor means is in an open or sheet-blocked state, wherein said sensor means comprises:

an input sensor located proximate said sheet kicker means of the collator, wherein said input sensor notifies said computer means of the entry of a sheet into the collator;

an output sensor located proximate said sheet stop means of the collator, wherein said output sensor notifies said computer means that said aligned packet is starting to exit the collator; and an internal sensor located between said sheet kicker means and said sheet stop means of the collator, wherein said internal sensor notifies said computer means that no sheet remains within the collator after said aligned sheet packet exits the collator and before one or more sheets for a new packet arrive.

* * * * *